US007306328B2

(12) United States Patent
Ito

(10) Patent No.: US 7,306,328 B2
(45) Date of Patent: Dec. 11, 2007

(54) INK JET PRINTER HEAD

(75) Inventor: Atsushi Ito, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 350 days.

(21) Appl. No.: 10/933,716

(22) Filed: Sep. 3, 2004

(65) Prior Publication Data

US 2005/0052505 A1 Mar. 10, 2005

(30) Foreign Application Priority Data

Sep. 4, 2003 (JP) ..... 2003-312396

(51) Int. Cl.
*B41J 2/045* (2006.01)

(52) U.S. Cl. ..... 347/71

(58) Field of Classification Search ..... 347/68–72
See application file for complete search history.

(56) References Cited

U.S. PATENT DOCUMENTS 5,831,651 A * 11/1998 Usui et al. ..... 347/70
6,036,303 A * 3/2000 Yamamoto et al. ..... 347/70
6,497,019 B1 * 12/2002 Yun ..... 29/25.35
2002/0024568 A1 2/2002 Ito et al.

FOREIGN PATENT DOCUMENTS

JP 2002-144590 5/2002

* cited by examiner

*Primary Examiner*—Stephen Meier
*Assistant Examiner*—Geoffrey S. Mruk
(74) *Attorney, Agent, or Firm*—Reed Smith LLP

(57) ABSTRACT

An ink jet printer head including a cavity unit having a plurality of ink ejection nozzles. The cavity unit and an actuator are stacked on each other. The cavity unit is constituted by a plurality of sheet members which are stacked on each other. A spacer sheet is provided which is interposed between a base sheet and at least one manifold sheet. The spacer sheet is more rigid than each of sheet members other than at least one spacer sheet. The spacer sheet has a thickness of from about 800 μm to about 500 μm and each of at least the base sheet and the manifold sheet has a thickness of about 50 μm and about 150 μm.

22 Claims, 7 Drawing Sheets

FIG.6A
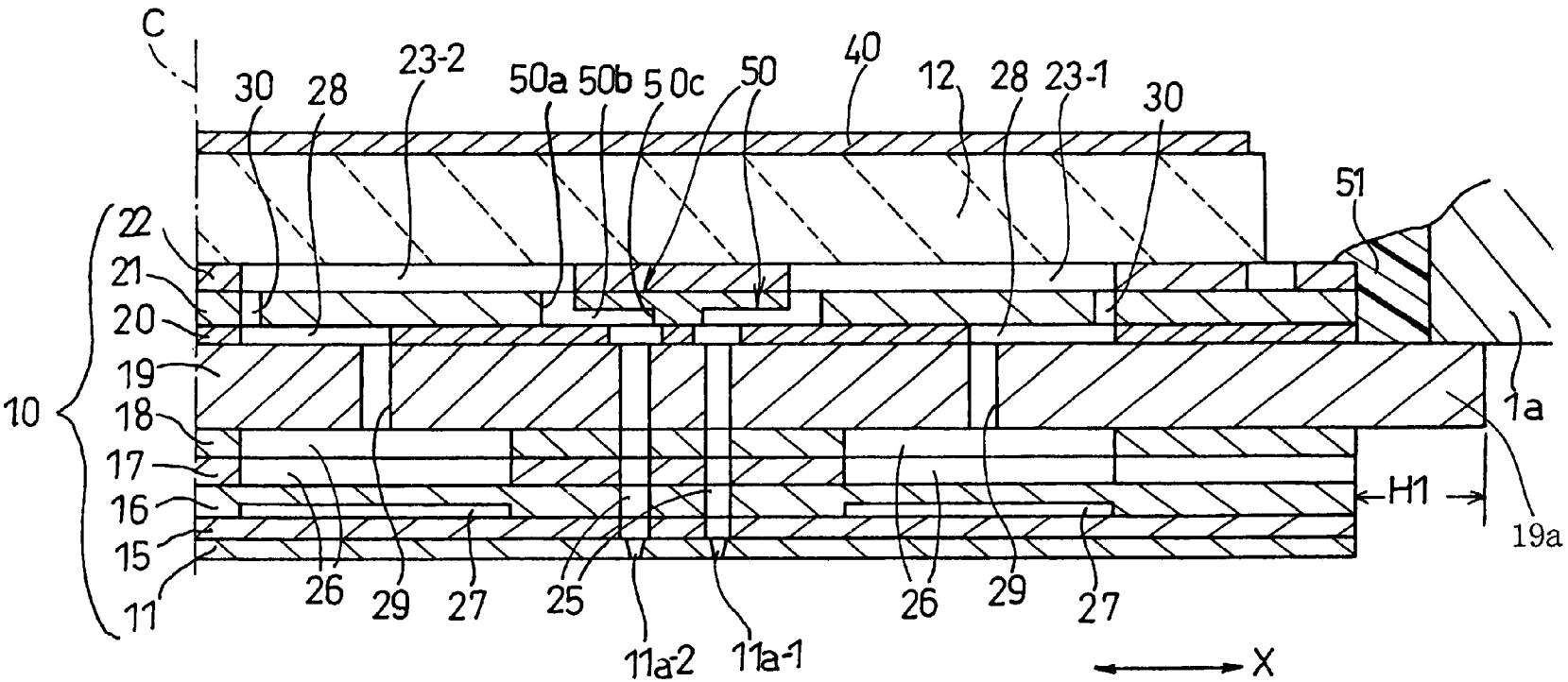
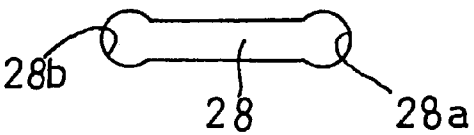
FIG.6B

INK JET PRINTER HEAD

The present application is based on Japanese Patent Application No. 2003-312396 filed on Sep. 4, 2003, the contents of which are incorporated herein by reference.

BACKGROUND OF THE INVENTION

1. Field of the Invention

The present invention relates to an ink jet printer head such as a piezoelectric ink jet printer head.

2. Discussion of Related Art

Japanese Patent Application Publication No. P2002-144590A or its corresponding U.S. Patent Application Publication No. US 2002/0024568A1 discloses an on-demand piezoelectric ink jet printer head which is essentially constituted by a head unit having a plurality of ink ejection nozzles arranged in a direction perpendicular to a printing direction in which a carriage is moved. The head unit includes (a) a cavity unit having the ink ejection nozzles, a plurality of pressure chambers communicating with the ink ejection nozzles, respectively, and a manifold chamber which supplies ink to each of the pressure chambers; (b) a piezoelectric actuator which is provided on a back or upper surface of the cavity unit and includes a plurality of active portions corresponding to the pressure chambers, respectively; and (c) a flexible flat cable which sends a plurality of electric signals to the piezoelectric actuator.

In the head unit disclosed by the above-indicated publications, the cavity unit is constituted by a plurality of thin sheet members which are stacked on each other and are bonded with adhesive to each other, and the piezoelectric actuator that is also of a sheet-member-stacked type is bonded with adhesive to the back or upper surface of the cavity unit. According to the above-indicated publications, a back or upper surface of the head unit is fixed to a support member mounted on the carriage, in such a manner that edge portions of the back or upper surface of the cavity unit of the head unit is bonded with adhesive to a bottom wall of a synthetic-resin-based head holder as the support member. An ink cartridge is detachably attached to an upper surface of the head holder.

SUMMARY OF THE INVENTION

The sheet members constituting the cavity unit of the head unit include a base sheet having the pressure chambers; a manifold sheet having the manifold chamber storing ink supplied from an ink supply source and delivering the ink to each of the pressure chambers, such that the manifold chamber is at least partly opposed to the each pressure chamber in the direction of stacking of the sheet members; at least one spacer sheet interposed between the base sheet and the manifold sheet; and a nozzle sheet having the ink ejection nozzles communicating with the pressure chambers, respectively. Each of the sheet members is formed of a nickel alloy steel sheet, and has a very small thickness of about 100 μm. Thus, the cavity unit is flat, and is low in rigidity, i.e., "soft".

Meanwhile, there are some cases where the total number of the ink ejection nozzles is increased and accordingly the length of the cavity unit in the direction in which the nozzles are arranged is increased, and other cases where the nozzles of the cavity unit are arranged in a plurality of (e.g., four) arrays that are separate from each other in the printing direction perpendicular to a sheet feeding direction in which a recording sheet is fed. In those cases, when the piezoelectric actuator is driven or operated to eject ink from a portion of the ink ejection nozzles of an arbitrary one of the arrays, so as to print, e.g., a straight line long in the sheet feeding direction, displacements of the corresponding active portions of the actuator may produce such a pressure or oscillatory wave that causes the flat and soft cavity unit as a whole to be flexed or bent like a wave. That is, the pressure or oscillatory wave produced by the displacements of those active portions corresponding to the certain nozzles of the arbitrary array may act on, or influence, not only the pressure chambers corresponding to the other ink ejection nozzles of the same array that should not eject the ink, but also the pressure chambers and/or manifold chambers corresponding to another or other arrays of ink ejection nozzles that should not eject the ink. In those cases, however, those ink ejection nozzles may unexpectedly eject the ink. This is so-called "cross-talk". The phenomenon of "cross-talk" cannot be effectively solved by strongly adhering and fixing an entire peripheral portion of the flat cavity unit to the head holder. In particular, in the case where a full-color ink jet printer head has four arrays of ink ejection nozzles respectively corresponding to four color inks, i.e., black, cyan, yellow, and magenta inks, the cross-talk may seriously lower the quality of color images printed by the printer head.

It is therefore an object of the present invention to provide an ink jet printer head which is free of at least one of the above-identified problems. It is another object of the present invention to provide an ink jet printer head which is free of the problem of cross-talk and enjoys a simple construction.

The above objects may be achieved according to the present invention. According to the present invention, there is provided an ink jet printer head, comprising a cavity unit having a plurality of ink ejection nozzles arranged in at least one array, and a plurality of pressure chambers arranged in at least one array and communicating with the ink ejection nozzles, respectively; and an actuator having a plurality of active portions each of which is driven to change a pressure of an ink accommodated in a corresponding one of the pressure chambers, and thereby eject, from a corresponding one of the ink ejection nozzles, a droplet of the ink. The cavity unit and the actuator are stacked on each other. The cavity unit is constituted by a plurality of sheet members which are stacked on each other and which include a base sheet having the pressure chambers; at least one manifold sheet which has at least one manifold chamber storing the ink supplied from an ink supply source and delivering the ink to each of the pressure chambers, at a location where said at least one manifold chamber is at least partly opposed to said each pressure chamber in a direction of stacking of the sheet members; at least one spacer sheet which is interposed between the base sheet and said at least one manifold sheet; and a nozzle sheet having the ink ejection nozzles communicating with the pressure chambers. The at least one spacer sheet has a first rigidity higher than a second rigidity of the sheet members other than the at least one spacer sheet.

In the present ink jet printer head, even if, when the actuator is operated and displaced, such a pressure or oscillatory wave may be produced which could otherwise cause the cavity unit as a whole to be flexed like a wave, the provision of the spacer sheet having the first or high rigidity can effectively restrict the deformation of the cavity unit as a whole. That is, the pressure or oscillatory wave produced by the displacement of the actuator can be effectively prevented from acting on, or influencing, the pressure chambers and/or the manifold chamber(s) corresponding to one or more arrays of ink ejection nozzles that should not eject the ink. Thus, the present ink jet printer head can effectively prevent the "unexpected" nozzles from ejecting the ink, i.e., the phenomenon of "cross-talk".

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which:

FIG. 6A is an enlarged, cross-sectional view taken along 6A-6A in FIG. 4;

FIG. 6B is an enlarged, plan view of a restrictor passage formed in a sheet member of the cavity unit.

DETAILED DESCRIPTION OF THE PREFERRED EMBODIMENTS

Hereinafter, there will be described a preferred embodiment of the present invention by reference to the drawings.

Figure 1:
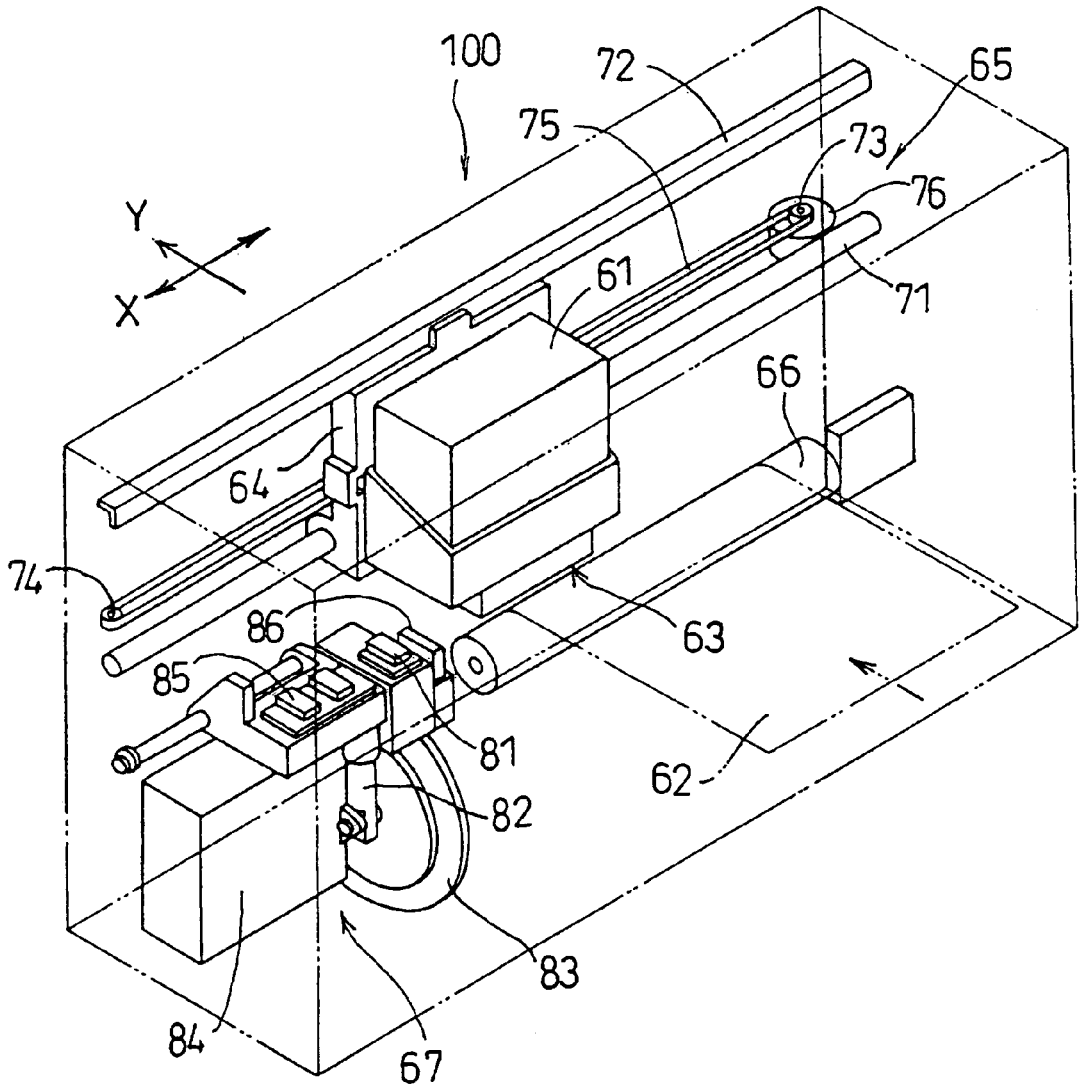
FIG. 1 is a perspective view of an ink jet printer to which the present invention is applied.

The present invention relates to a full-color ink jet printer 100 shown in FIG. 1. The full-color ink jet printer 100 includes an ink cartridge 61 which stores four color inks, i.e., cyan, magenta, yellow, and black inks, such that the four color inks are separated from each other in the cartridge 61. The ink jet printer 100 additionally includes an ink jet printer head 63 which prints or records an image on a sheet of paper 62 as a sort of recording medium that is fed in a first direction, i.e., a Y direction indicated by an arrow in FIG. 1; a carriage 64 on which the ink cartridge 61 and the printer head 63 are mounted; a driving unit 65 which linearly reciprocates the carriage 54 in a second direction, i.e., an X direction perpendicular to the first or Y direction in which the recording sheet 62 is fed; a platen roller 66 which extends parallel to the X direction and is opposed to the printer head 63; and a purging device 67.

The driving unit 65 includes a guide bar 71 which extends through a lower end portion of the carriage 64, in a direction parallel to the platen roller 66; a guide plate 72 which engages an upper end portion of the carriage 64, and extends parallel to the guide bar 71; two pulleys 73, 74 which are provided between the guide bar 71 and the guide plate 72, and in respective vicinities of axially opposite end portions of the guide bar 71; and a timing belt 75 which is wound on the two pulleys 73, 74 and a portion of which is secured to the carriage 64.

When an electric motor 76 is driven or operated, the first pulley 73 is rotated, and the timing belt 75 is linearly reciprocated while the carriage 64 is guided by the guide bar 71 and the guide plate 72.

The recording sheet 62 is supplied from a sheet supplying device, not shown, in the Y direction, and is fed to a gap provided between the platen roller 66 and the printer head 63, so that a desired image is recorded on the recording sheet 62, with the color inks ejected from the printer head 63, as will be described later. Subsequently, the recording sheet 62 is discharged from the ink jet printer 100.

The purging device 67 is provided on one side of the platen roller 66, such that when the carriage 64 is positioned at a resetting position, the purging device 67 is opposed to the printer head 63 mounted on the carriage 64. The purging device 67 includes a purging cap 81 which contacts a front or lower surface of the printer head 63 so as to cover a plurality of ink ejection nozzles 11*a* (FIGS. 6A and 7, described later) of the same 63 that open in the lower surface; an electric pump 82 and a cam 83; and an ink container 84. While the printer head 63 is positioned at the resetting position, bad inks remaining in the same 63 and containing air bubbles are sucked by the pump 82 driven by the cam 83, so that the function of the printer head 63 may be recovered. The bad inks sucked by the pump 82 are accumulated in the ink container 84.

A wiper member 86 is provided between the purging device 67 and the platen roller 66. The wiper 86 has a plate-like shape and, as the carriage 64 is moved, the wiper 86 wipes the lower surface of the printer head 63 and the respective openings of the ink ejection nozzles 11*a*. When the wiper 86 is used to wipe the printer head 63, the wiper 86 is advanced upward; and when it is not used, it is retracted downward.

When the carriage 64 is positioned at the resetting position after its recording operation, ink-drying preventing caps 85 cover the ink ejection nozzles 11*a* of the printer head 63 mounted on the carriage 64. Thus, the caps 85 prevent drying of the inks remaining in the nozzles 11*a*.

Figure 3:
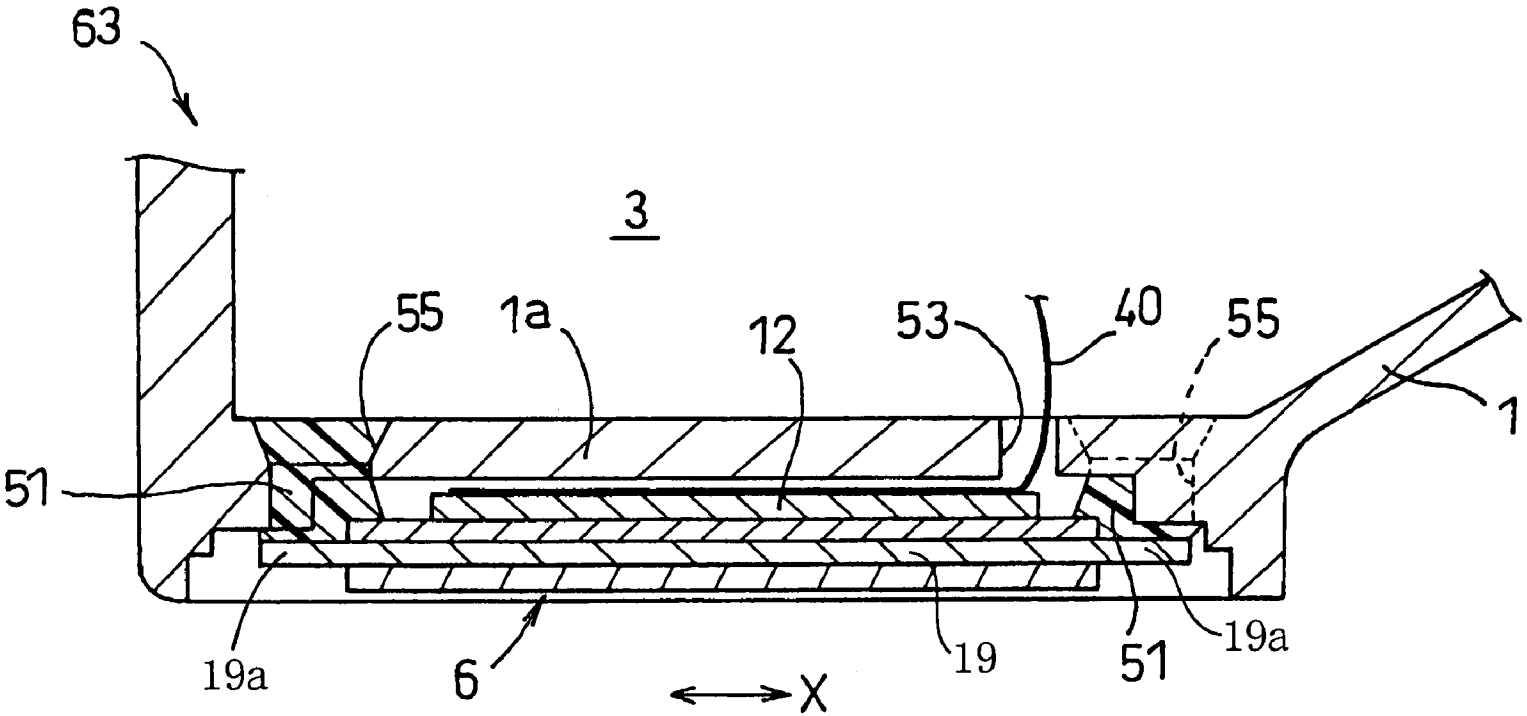
FIG. 3 is a cross-sectional view taken along 3-3 in FIG. 2.

As shown in FIG. 3, the ink jet printer head 63 includes a head unit 6 which has, in a front surface thereof (i.e., the lower surface of the printer head 63), the ink ejection nozzles 11*a* that are arranged in a plurality of arrays in the Y direction; and a head holder 1 to which a back or upper surface of the head unit 6 is fixed with an adhesive 51, described later. In the present embodiment, the head holder 1 provides the support member that supports the head unit 6. However, a metallic frame, not shown, may be fixed with adhesive to the back surface of the head unit 6, and the metallic frame may be attached to the head holder 1.

The head holder 1 includes an ink-cartridge holding portion 3 which holds the above-described ink cartridge 61, and the ink cartridge 61 supplies the four color inks to the head unit 6 via respective cylindrical ink-supply sleeves 4 (FIG. 2), described later.

Figure 4:
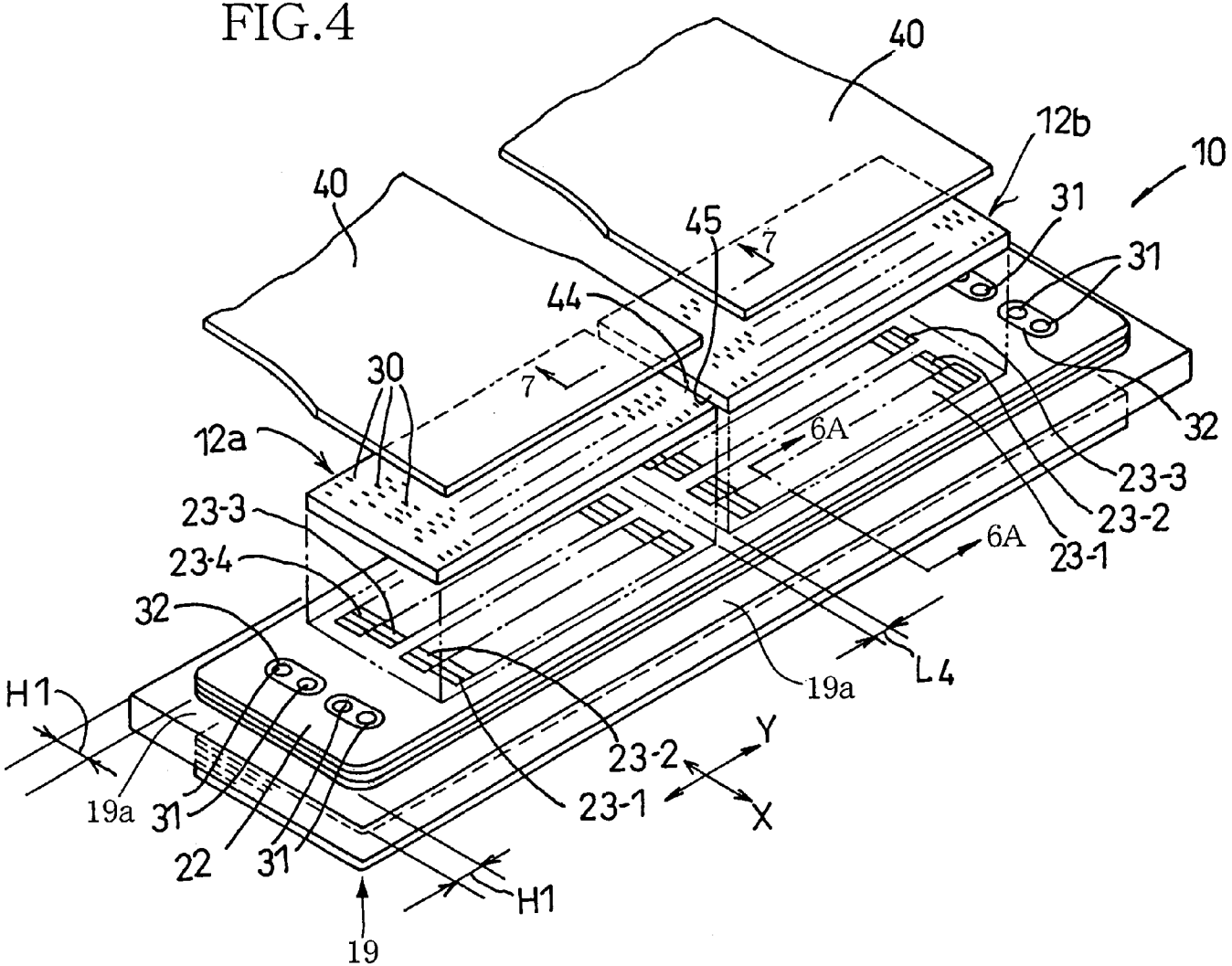
FIG. 4 is a perspective view of the ink jet printer head, a cavity unit, two piezoelectric actuators, and two flexible flat cables of the printer head being separated from each other for illustrative purposes only.

First, there will be described a construction of the head unit 6. As shown in FIG. 4, the head unit 6 includes a cavity unit 10 which is constituted by a plurality of sheet members stacked on each other; two sheet-stacked-type piezoelectric actuators 12 (12*a*, 12*b*) each of which is stacked on, and fixed with adhesive to, the cavity unit 10; and two flexible flat cables 40, 40 which are stacked on, and bonded to, respective back or upper surfaces of the two piezoelectric actuators 12*a*, 12*b*, so as to connect electrically the actuators 12*a*, 12*b* to an external device, not shown.

Figure 2:
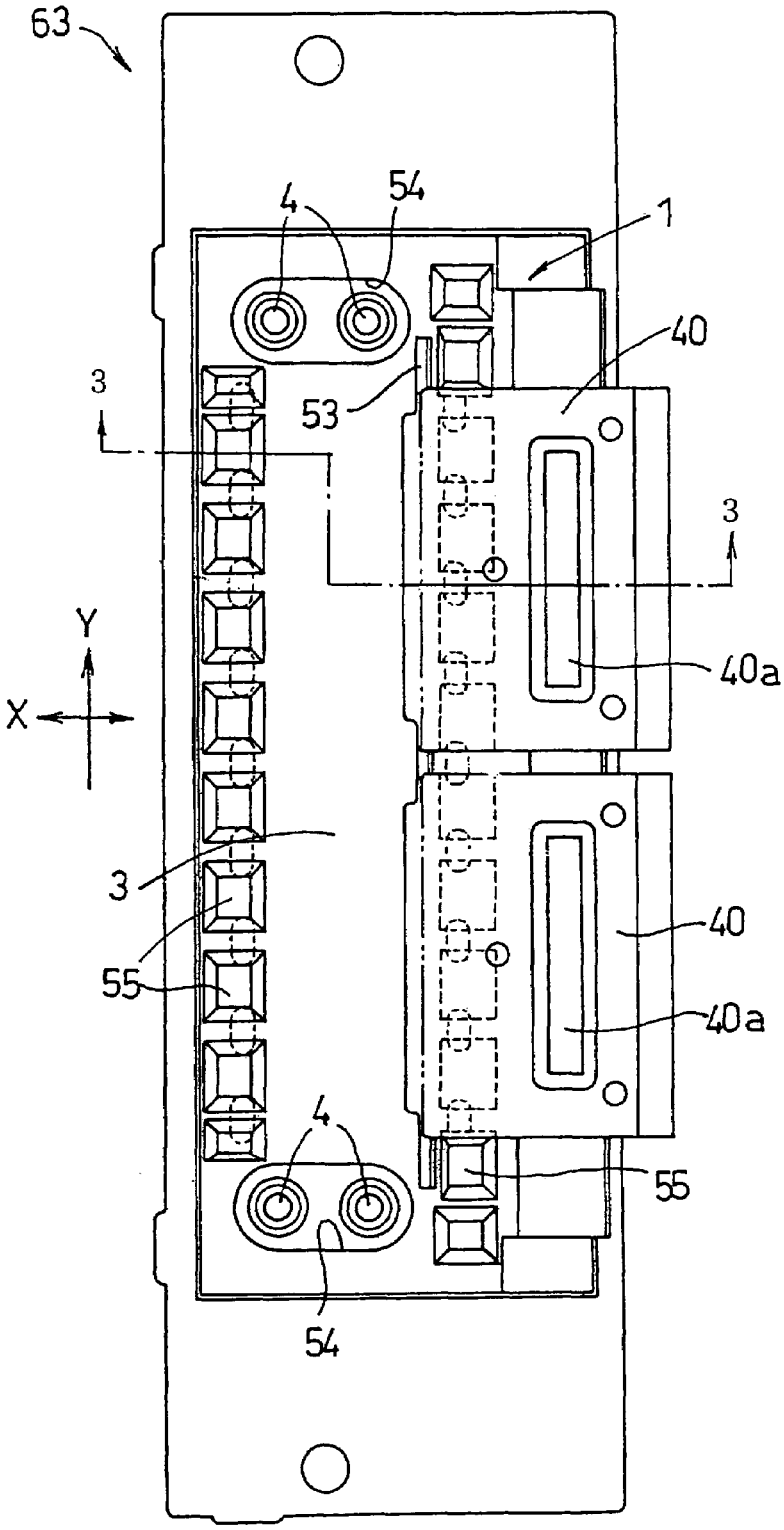
FIG. 2 is a plan view of a back or upper surface of an ink jet printer head of the printer of FIG. 1.

As shown in FIGS. 2 and 4, the head unit 6 has a shape elongate in the Y direction in which the ink ejection nozzles 11*a* are arranged, and accordingly the printer head 63 including the head unit 6 is elongate in the Y direction.

The cavity unit 10 is constructed as shown in FIGS. 4, 5, 6A, 6B, and 7. More specifically described, the cavity unit 10 includes nine flat sheet members that are stacked on, and bonded with adhesive to, each other. The nine sheet members include, in the order from the bottom, to the top, of the cavity unit 10, a nozzle sheet 11, an intermediate sheet 15, a damper sheet 16, two manifold sheets 17, 18, three spacer sheets 19, 20, 21, and a base sheet 22. The base sheet 22 has a plurality of pressure chambers 23 arranged in four arrays 23-1, 23-2, 23-3, 23-4.

The first spacer sheet 19 as one of the three spacer sheets 19, 20, 21 has a rigidity significantly higher than those of the other sheet members 11, 15 through 18, and 20 through 22.

However, in place of, or in addition to, the first spacer sheet 19, at least one of the other spacer sheets 20, 21 than the first spacer sheet 19 may have a rigidity significantly higher than those of the other sheet members.

Thus, the cavity unit 10 as a whole has an increased rigidity. In the present embodiment, the "rigidity" of the cavity unit 10 or each sheet member 11, 15 through 22 thereof is defined as its flexural rigidity against an external force applied thereto to deform or curve the cavity unit 10 or the each sheet member that has such a flat shape that its dimension in the direction of stacking (i.e., respective thickness) of the sheet members 11, 15 through 22 is considerably small relative to its lengthwise and widthwise dimensions. The flexural rigidity of the cavity unit 10 or the each sheet member is obtained as the product of its modulus of longitudinal elasticity and its cross-sectional secondary moment, and is exhibited against its flexural vibration or its bending deformation caused by the external force exerted perpendicularly to its major surfaces in a state in which its outer peripheral portions are secured.

The rigidity of the cavity unit 10 as a whole is increased in the following manners: First, each of the sheet members 15 through 22 other than the nozzle sheet 11 formed of a synthetic resin, is formed of a 42% nickel alloy steel sheet, and each of the metallic sheet members 15 through 18 and 20 through 22 other than the first spacer sheet 19 has a thickness of from about 50 μm to about 150 μm. The first spacer sheet 19, placed on the second manifold sheet 18, has a thickness of from about 300 μm to about 500 μm, and accordingly has a significantly higher rigidity than those of the other metallic sheet members 15 through 18, and 20 through 22. Preferably, the rigidity of the first spacer sheet 19 is higher than those of the other sheet members 11, 15 through 18, and 20 through 22, by not less than 100%. In the present embodiment, the first spacer sheet 19 has a plan-view shape larger than that of the other sheet members. More specifically described, the other sheet members have a substantially rectangular plan-view contour, and the first spacer sheet 19 has a similar rectangular plan-view contour, but the first spacer sheet 19 projects laterally outward from the other sheet members by an appropriate dimension H1, as shown in FIG. 4.

For the purpose of increasing the rigidity of the first spacer sheet 19, the first spacer sheet 19 may be formed of a material having a higher strength (i.e., a higher Young's modulus). For example, the other sheet members 11, 15 through 18, and 20 through 22 than the first spacer sheet 19 is formed of a tough hardening chromium steel, whereas the first spacer sheet 19 is formed of a nickel chromium molybdenum steel, a stainless steel, a tungsten steel, or a cobalt chromium tungsten steel that has a higher Young's modulus. Otherwise, the rigidity of the first spacer sheet 19 may be increased by quenching a carbon steel or an alloy steel used to form the same 19.

In the present embodiment, the rigidity of the first spacer sheet 19, provided above the second manifold sheet 18, is increased as described above. However, in addition to, or in place of, the rigidity of the first spacer sheet 19, the rigidity of the third spacer sheet 21, provided below the base sheet 22 having the pressure chambers 23, and/or the rigidity of the second spacer sheet 20 provided between the first and third spacer sheets 19, 21 may be increased. In the case where only a single spacer sheet is provided between the base sheet 22 and the second manifold sheet 18, the rigidity of that single spacer sheet is increased.

Figure 7:
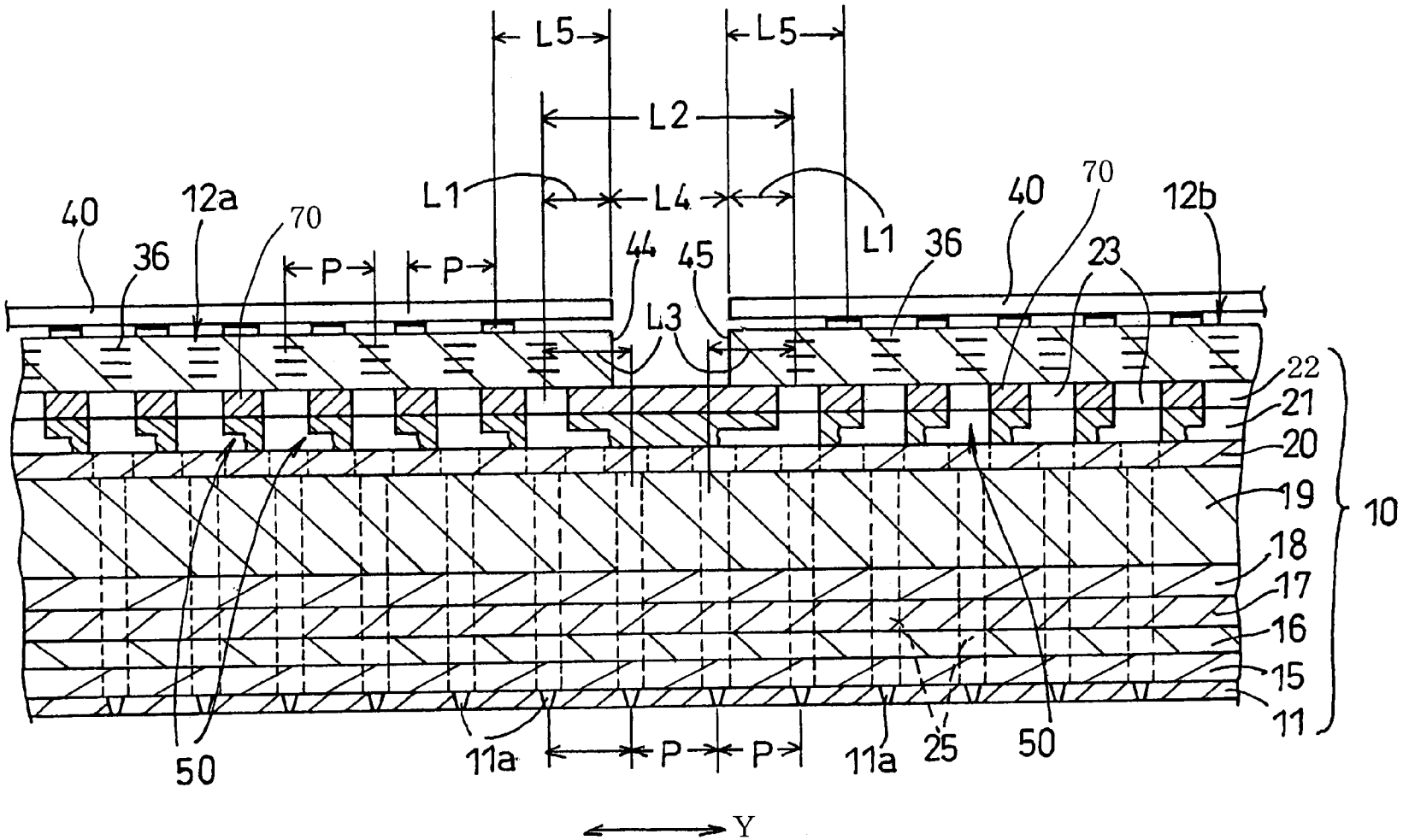
FIG. 7 is an enlarged, cross-sectional view taken along 7-7 in FIG. 4.

The nozzle sheet 11 has the ink ejection nozzles 11*a* each having a small diameter (e.g., about 25 μm), such that the nozzles 11*a* are arranged in two pairs of arrays, i.e., four arrays in total, and each pair of arrays of nozzles 11*a* are arranged in a staggered or zigzag fashion in a first direction, i.e., a lengthwise direction of the cavity unit 10 or the head unit 6, i.e., the Y direction indicated by arrows in FIG. 7.

FIG. 6A is a cross-sectional view of the cavity unit 10, taken along 6A-6A in FIG. 4, i.e., in the X direction or a widthwise direction of the cavity unit 10 or the head unit 6. More specifically described, FIG. 6A shows a half portion of the cavity unit 10, located on a right-hand side of a centerline, C, of the cavity unit 10 that extends parallel to the Y direction. The right-hand half portion of the cavity unit 10 has the first array of nozzles 11*a*-1 remote from the centerline C, and the second array of nozzles 11*a*-2 near to the centerline C. The two arrays of nozzles 11*a*-1, 11*a*-2 are arranged, in the zigzag fashion, along respective reference lines, not shown, that are near to each other and each extend parallel to the Y direction, and the nozzles of each array 11*a*-1, 11*a*-2 are formed through the thickness of the nozzle sheet 11, at a regular small pitch, P, (FIG. 7). Likewise, a left-hand half portion of the cavity unit 10 has the third array of nozzles 11*a* near to the centerline C, and the fourth array of nozzles 11*a* remote from the centerline C. The two arrays of nozzles 11*a* are arranged in the zigzag fashion along respective reference lines, not shown, that are near to each other and each extend parallel to the Y direction, and the nozzles 11*a* of each array are formed through the thickness of the nozzle sheet 11, at the same small pitch P. The first and second arrays of nozzles 11*a*-1, 11*a*-2, i.e., the first pair of arrays of nozzles, and the third and fourth arrays of nozzles 11*a*, i.e., the second pair of arrays of nozzles are parallel to each other, and are distant from each other in the widthwise direction of the cavity unit 10 or the head unit 6, i.e., the second or X direction. In the present embodiment, each of the first to fourth arrays of nozzles 11*a* is two-inch long, and consists of 150 nozzles. Thus, the density of the nozzles 11*a* of the head unit 6 is 75 dpi (dot per inch).

Figure 5:
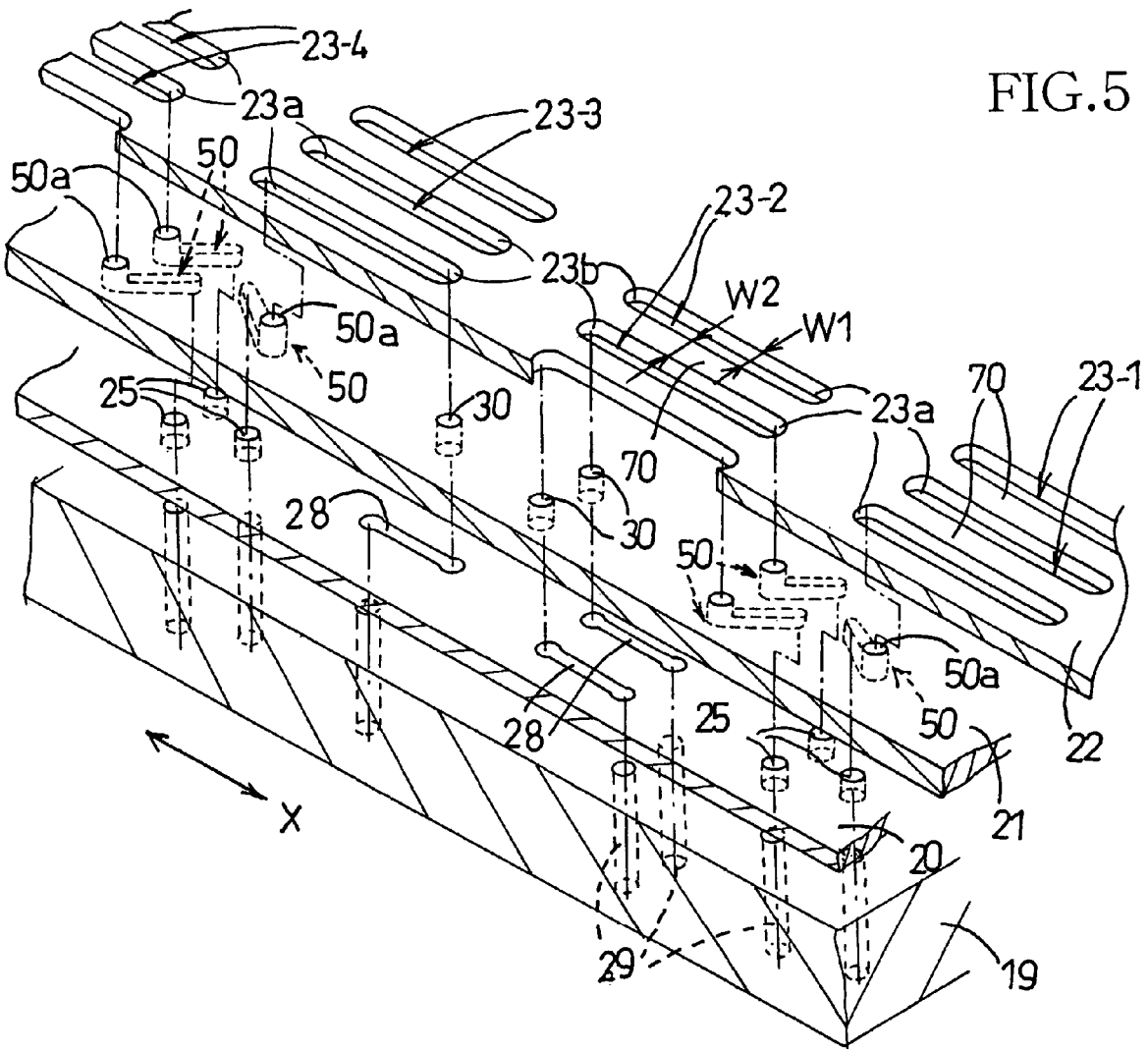
FIG. 5 is a perspective, exploded view of a portion of the cavity unit.

FIG. 4 shows the base sheet 22 as an uppermost sheet or layer of the cavity unit 10. The base sheet 22 has the four arrays of pressure chambers 23 (23-1, 23-2, 23-3, 23-4) corresponding to the four arrays of ink ejection nozzles 11*a*, respectively, such that the arrays of pressure chambers 23 extend in the lengthwise direction of the cavity unit 10, i.e., the Y direction. The pressure chambers 23 are formed through the thickness of the base sheet 22, at the same small pitch P as the regular small pitch P at which the ink ejection nozzles 11*a* are formed. Each of the pressure chambers 23 is elongate in a direction substantially parallel to the widthwise direction of the cavity unit 10, i.e., the X direction. Thus, each pair of adjacent pressure chambers 23 that are located adjacent each other in the Y direction are separated from each other by a partition wall 70 that is elongate in a direction substantially parallel to the X direction, as shown in FIGS. 5 and 7. Each of the partition walls 70 has a width W2 that is somewhat smaller than a width W1 of each of the pressure chambers 23, as shown in FIG. 5.

The pressure chambers of the first array 23-1 communicate with the ink ejection nozzles of the first array 11*a*-1, respectively. Likewise, the pressure chambers of the second array 23-2 communicate with the nozzles of the second array 11*a*-2, respectively; the pressure chambers of the third array 23-3 communicate with the nozzles 11*a* of the third array, respectively; and the pressure chambers of the fourth array 23-4 communicate with the nozzles 11*a* of the fourth array, respectively.

Next, there will be described a positional relationship between the four arrays of pressure chambers 23 of the base sheet 22 as the uppermost sheet of the cavity unit 10, and four arrays of active portions of the two piezoelectric actuators 12*a*, 12*b*. The two piezoelectric actuators 12*a*, 12*b* are provided on the base sheet 22, such that respective longitudinal axes of the two actuators 12*a*, 12*b* are aligned with each other in the same direction as the direction in which the four arrays of ink ejection nozzles 11*a* extend, i.e., in the first or Y direction.

As shown in FIGS. 4 and 7, the two piezoelectric actuators 12*a*, 12*b* operate respective half portions of the four arrays of pressure chambers 23 communicating with the four arrays of ink ejection nozzles 11*a*, and accordingly each actuator 12*a*, 12*b* has four groups of seventy-five active portions to operate four groups of seventy-five pressure chambers 23 as the respective half portions of the four arrays of pressure chambers 23. Thus, one of the two piezoelectric actuators 12*a*, 12*b* is provided on one of two half portions of the upper surface of the cavity unit 10 in the lengthwise direction thereof i.e., in the Y direction; and the other piezoelectric actuator is provided on the other half portion of the upper surface of the same 10.

As will be described later in more detail, each of the active portions of each piezoelectric actuator 12*a*, 12*b* includes, for a corresponding one of the pressure chambers 23, (a) respective portions of a plurality of piezoelectric sheets stacked on each other, (b) a plurality of proper individual electrodes 36, and (c) respective portions of a plurality of proper common electrodes, not shown, that are alternate with the proper individual electrodes 36 while the individual and common electrodes are alternate with the respective portions of the piezoelectric sheets. When an electric voltage is applied to the proper individual and common electrodes of an arbitrary one of the active portions, the one active portion is deformed, by longitudinal piezoelectric effect, in the direction of stacking of the piezoelectric sheets. Thus, the two piezoelectric actuators 12*a*, 12*b* cooperate with each other to provide the same number of active portions as the number of the pressure chambers 23 of the cavity unit 10, such that the active portions are arranged in the same number of arrays as the number (i.e., four) of the arrays of pressure chambers 23, and are provided at the respective positions aligned with the pressure chambers 23 in the direction of stacking of the piezoelectric sheets, as shown in FIG. 7.

In short, the active portions of the two piezoelectric actuators 12*a*, 12*b* are arranged in the four arrays in the same direction as the direction in which the ink ejection nozzles 11*a* or the pressure chambers 23 are arranged, i.e., in the Y direction, and the same number of active portions as the number (i.e., four) of the arrays of the nozzles 11*a* are arranged in the X direction. Each of the active portions is elongate in the X direction in which a corresponding one of the pressure chambers 23 is elongate, i.e., the widthwise direction of the cavity unit 10 or the head unit 6. The active portions of each of the four arrays are provided at the same small pitch P as the regular small pitch P at which the pressure chambers 23 are provided, as shown in FIG. 7. The first and second arrays of active portions corresponding to the first and second arrays of pressure chambers 23-1, 23-2 are arranged in the zigzag fashion and, likewise, the third and fourth arrays of active portions corresponding to the third and fourth arrays of pressure chambers 23-3, 23-4 are arranged in the zigzag fashion.

As shown in FIG. 4, the pressure chambers 23 are grouped into two groups corresponding to the two piezoelectric actuators 12*a*, 12*b* that are arranged in the lengthwise direction of the cavity unit 10, i.e., the Y direction. More specifically described, the first group of pressure chambers 23 corresponding to the first piezoelectric actuator 12*a* are located in one of the two half portions of the base sheet 22 in the Y direction parallel to the arrays of ink ejection nozzles 11*a*; and the second group of pressure chambers 23 corresponding to the second piezoelectric actuator 12*b* are located in the other half portion of the base sheet 22. In each of the two groups of pressure chambers 23, the pressure chambers 23 are arranged in the four arrays, such that first and second arrays of pressure chambers are arranged in the zigzag fashion and the third and fourth arrays of pressure chambers are also arranged in the zigzag fashion, and such that the pressure chambers 23 of each of the four arrays are provided at the same small pitch P as the regular small pitch P at which the ink ejection nozzles 11*a* are provided.

Each of the pressure chambers 23 is elongate in the widthwise direction of the cavity unit 10, i.e., in the second or X direction, and is formed through the thickness of the base sheet 22. Each pressure chamber 23 has an inlet end 23*b* that communicates with a corresponding one of manifold chambers 26, described later, via a second ink passage 30 formed in the third spacer sheet 21, a restrictor passage 28 formed in the second spacer sheet 20, and a first ink passage 29 formed in the first spacer sheet 19, as shown in FIGS. 5 and 6A.

In addition, each of the pressure chambers 23 has an outlet end 23*a* that communicates with a corresponding one of the ink ejection nozzles 11*a* via respective communication passages 25 as respective ink channels that are formed in the three spacer sheets 21, 20, 19, the two manifold sheets 18, 17, the damper sheet 16, and the intermediate sheet 15 all of which are interposed between the base sheet 22 and the nozzle sheet 11. One of the communication passages 25 that is formed in the third spacer sheet 21 is provided in the form of a bottomed groove 50 that extends substantially parallel to a plane defined by a lower surface of the third spacer sheet 21. However, at least one of the communication passages 25 that is formed in at least one of the sheet members 21 through 15 interposed between the base sheet 22 and the nozzle sheet 11 may be provided in the form of the bottomed groove 50. Thus, as shown in FIGS. 5 and 7, the outlet end 23*a* of each pressure chamber 23 from which ink flows out is distant from the corresponding ink ejection nozzle 24 by a distance, L3, in the first or Y direction.

More specifically described, as shown in FIGS. 4 and 7, the above-indicated two groups of pressure chambers 23 of the cavity unit 10, or, the respective groups of active portions of the two piezoelectric actuators 12*a*, 12*b* are distant from each other by a distance, L2, that is longer than the regular small pitch P at which the pressure chambers 23 are arranged in each group in the lengthwise direction of the base sheet 22. Meanwhile, it is difficult to manufacture each piezoelectric actuator 12*a*, 12*b* in such a manner that a distance, L1, between the proper individual electrodes 36 of the respective outermost active portions of the four arrays of active portions of the each piezoelectric actuator 12*a*, 12*b*, and a corresponding end 44, 45 of the same 12*a*, 12*b* is not greater than half the regular small pitch P at which the proper individual electrodes 36 are provided in the each actuator 12*a*, 12*b* in the lengthwise direction of the same 12*a*, 12*b*. Therefore, it is easier to manufacture the piezoelectric actuators 12*a*, 12*b* such that the distance L1 is greater than half the small pitch P, i.e., $L1>P/2$, and accordingly the distance L2 is greater than the small pitch P, i.e., $L2>P$.

Thus, as shown in FIGS. 4 and 7, the two piezoelectric actuators 12*a*, 12*b* are arranged in series on the cavity unit 10, such that the respective ends 44, 45 of the two actuators 12*a*, 12*b* are opposed to each other, and are distant from each other by a distance, L4, i.e., $L2=2L1+L4$.

That is, all the ink ejection nozzles 11*a* of each of the four arrays are arranged at the regular small pitch P, but each of the nozzles 11*a* is distant from a corresponding one of the pressure chambers 23 by the distance L3 in the first or Y direction. As described above, the outlet end 23*a* of each pressure chamber 23 communicates with the corresponding nozzle 24 via the communication passages 25 at least one of which is provided in the form of the bottomed groove 50 extending parallel to the plane defined by at least one 21 of the sheet members 21 through 15 in which the bottomed groove 50 is formed. Therefore, the other communication passages 25 are simply formed vertically through the respective thickness of the other sheet members 20 through 15, and are connected to one of opposite ends of the bottomed groove 50 formed in the sheet member 21. Owing to this simple construction, each nozzle 24 is made distant from the corresponding pressure chamber 23 by the distance L3 in the first or Y direction. However, as shown in FIG. 5, each of the bottomed grooves 50 extends not only in the first direction but also in the second direction in which the corresponding pressure chamber 23 extends. Thus, the two groups of bottomed grooves 50 corresponding to the two groups of pressure chambers 23 are symmetrical with each other with respect to a bisector of the distance L2, such that each of the bottomed grooves 50 is inclined relative to the bisector.

In the present embodiment, the bottomed grooves 50 are formed in the third spacer sheet 21 located adjacent the lower surface of the base sheet 22 having the pressure chambers 23. The bottomed grooves 50 will be described in more detail by reference to FIGS. 5 and 6A. Each of the bottomed grooves 50 includes one end 50*a* opening in the upper surface of the third spacer sheet 21 and communicating with the outlet end 23*a* of the corresponding pressure chamber 23; a bottomed horizontal passage 50*b* opening in the lower surface of the third spacer sheet 21; and another end 50*c* communicating with an upper end of the corresponding vertical communication passage 25 formed through the thickness of the second spacer sheet 20 underlying the third spacer sheet 21.

Thus, the communication passages 25 as the ink channels connecting between the pressure chambers 23 of the base sheet 22 and the corresponding ink ejection nozzles 11*a* of the nozzle sheet 11 can be easily designed such that the corresponding nozzles 11*a* are largely deviated from the pressure chambers 23, because at least one of the communication passages 25 corresponding to each pressure chamber 23 is provided in the form of the bottomed groove 50 extending parallel to the plane defined by the third spacer sheet 21, and the other communication passages 25 are formed through the respective thickness of the other sheet members 20 through 15 in the respective directions perpendicular to the respective planes defined by those sheet members 20 through 15. In addition, it is also easy to design respective overall lengths of the communication passages 25 as the ink channels connecting between the pressure chambers 23 and the corresponding nozzles 11*a* (each overall length is defined as including the length of the corresponding bottomed groove 50), such that the respective overall lengths of the communication passages 25 are substantially equal to each other.

The two manifold sheets 17, 18 cooperate with each other to define a plurality of manifold chambers 26, such that the manifold chambers 26 extend along the arrays of ink ejection nozzles 11*a*, respectively. More specifically described, each of the manifold chambers 26 has a length corresponding to a quotient obtained by dividing the length of each array of pressure chambers 23 in the first direction, by an appropriate integral number. In the present embodiment, each manifold chamber 26 has a length corresponding to the length of each array of pressure chambers 23 in each of the above-described two groups. Each group has seventy-five pressure chambers 23 in each array. Thus, the length of each manifold chamber 26 corresponds to the length of seventy-five pressure chambers 23 arranged in the first direction. Thus, the two manifold sheets 17, 18 define eight manifold chambers 26 in total. One of lengthwise opposite ends of each of the eight manifold chambers 26 communicates with a corresponding one of eight ink-supply holes 31 that are formed in the three spacer sheets 19, 20, 21 and the base sheet 22 that are stacked on the manifold sheets 17, 18.

Each of the eight manifold chambers 26 is formed, by etching, through the respective thickness of the two manifold sheets 17, 18, and is fluid-tightly closed by the first spacer sheet 19 stacked on the upper manifold sheet 18, and the damper sheet 16 located beneath the lower manifold sheet 17. The damper sheet 16 has eight damper chambers 27 which are formed, by etching, in a lower surface of the sheet 16 and each of which has a plan-view shape identical with that of each manifold chamber 26.

A pressure wave applied by an arbitrary one of the active portions of the two piezoelectric actuators 12*a*, 12*b* to a corresponding one of the pressure chambers 23 includes a backward component that propagates backward via the ink to the corresponding manifold chamber 26. This backward component is effectively absorbed by the vibration of the thin damper sheet 16, and accordingly so-called "cross-talk" between two or more pressure chambers 23 located adjacent each other can be effectively prevented.

The second spacer sheet 20 has the restrictor passages 28 each of which restricts the flow of ink. As shown in FIG. 6B, each of the restrictor passages 28 has a plan-view shape including two lengthwise opposite end portions 28*a*, 28*b*, and an intermediate portion whose width is smaller than that of the end portions 28*a*, 28*b*. Each restrictor passage 28 is elongate in a direction parallel to the direction in which the corresponding pressure chamber 23 is elongate. Each restrictor passage 28 is fluid-tightly closed by the third spacer sheet 21 stacked on an upper surface of the second spacer sheet 20, and the first spacer sheet 19 located beneath a lower surface of the same 20. As shown in FIGS. 5 and 6A, the first spacer sheet 19 has the first ink passages 29 which are formed through the thickness thereof and each of which communicates, at one end thereof, with a corresponding one of the manifold chambers 26 and communicates, at the other end thereof, with the one end portion 28*a* of a corresponding one of the restrictor passages 28; and the third spacer sheet 21 has the second ink passages 30 which are formed through the thickness thereof and each of which communicates, at one end thereof, with the inlet end 23*b* of a corresponding one of the pressure chambers 23 and communicates, at the other end thereof, with the other end portion 28*b* of a corresponding one of the restrictor passages 28.

As shown in FIG. 4, the cavity unit 10 has the eight ink-supply holes 31 corresponding to the eight manifold chambers 26, i.e., the four pairs of ink-supply holes 31 corresponding to the four color inks, respectively. Each pair of ink-supply holes 31 are covered with a filter 32 which is fixed with adhesive to an upper surface of the base sheet 22 and which removes dust from the corresponding ink supplied from the ink cartridge 61.

As shown in FIG. 2, the four cylindrical sleeves 4 are provided on the upper surface of the base sheet 22, such that the four sleeves 4 are aligned with the four filters 32, i.e., the four pairs of ink-supply holes 31, respectively, so that the four sleeves 4 receive the four color inks, respectively, from the ink cartridge 61. Each of the four sleeves 4 has an inner ink-flow passage, and includes a lower large-diameter portion and an upper small-diameter portion, and a lower end surface of the each sleeve 4 is strongly adhered and fixed with, e.g., an epoxy resin to the corresponding filter 32. In addition, an annular elastic seal member, not shown, such as a rubber packing or an O-ring is fitted on the upper small-diameter portion of each sleeve 4, so that the each sleeve 4 may be connected to the ink cartridge 61 via a flow-channel member, not shown, while the ink is effectively prevented from leaking from the each sleeve 4.

Each of the two piezoelectric actuators 12*a*, 12*b*, shown in FIGS. 4 and 7, has a construction in which a plurality of piezoelectric sheets are stacked on each other. This construction is disclosed by, e.g., Japanese Patent Application Publication No. 4-341851. As shown in FIG. 7, in each piezoelectric actuator 12*a*, 12*b*, an internal-individual-electrode layer, i.e., four arrays of internal individual electrodes 36 (only one array of internal individual electrodes 36 are shown) each having a small width are provided, on a planar upper surface of each of every second piezoelectric sheets as counted in an upward direction from its bottom sheet, at respective positions corresponding to the pressure chambers 23 of the cavity unit 10, such that the four arrays of individual electrodes 36 extend in a lengthwise direction of the piezoelectric actuator 12*a*, 12*b*, i.e., in the Y direction. In addition, an internal common electrode, not shown, which are common to all the pressure chambers 23 is provided on a planar upper surface of each of the other piezoelectric sheets of each piezoelectric actuator 12*a*, 12*b*. The individual electrodes 36 of each one of the individual-electrode layers are aligned with the individual electrodes 36 of the other individual-electrode layers, in the direction of stacking of the piezoelectric sheets of each piezoelectric actuator 12*a*, 12*b*, and the four arrays of individual electrodes 36 of all the individual-electrode layers cooperate with the common electrodes to sandwich four arrays of active portions of each one of the piezoelectric sheets, in the direction of stacking of the piezoelectric sheets. Those active portions of each piezoelectric sheet are deformed by the longitudinal piezoelectric effect. As shown in FIG. 4, on an upper surface of the top sheet of each piezoelectric actuator 12*a*, 12*b*, there are provided four arrays of external individual electrodes 30 that are electrically connected to the four arrays of individual electrodes 36 of each one of the individual-electrode layers, and one or more external common electrodes, not shown, that is or are electrically connected to each one of the internal common electrodes.

The piezoelectric actuators 12*a*, 12*b* each of which is constructed as described above are fixed to the cavity unit 10 such that the internal individual electrodes 36 of the actuators 12*a*, 12*b* are aligned with the pressure chambers 23 of the cavity unit 10, respectively. In the present embodiment, since the cavity unit 10 is elongate, the two piezoelectric actuators 12*a*, 12*b* are fixed to the cavity unit 10 such that the two actuators 12*a*, 12*b* are arranged in the lengthwise direction of the cavity unit 10, i.e., the Y direction.

In addition, the two flexible flat cables 40 are fixed to the respective back or upper surfaces of the two piezoelectric actuators 12*a*, 12*b*, such that a plurality of electric wires, not shown, of the flat cables 40 are electrically connected to the external individual electrodes 30 and the external common electrodes, not shown, of the flat cables 40, respectively. In the present embodiment, two IC chips 40*a*, 40*a* are connected to the two flexible flat cables 40, 40, respectively, as shown in FIG. 2.

In the ink jet printer head 63 constructed as described above, when an electric voltage is applied to (a) the internal individual electrodes 36 of an arbitrary one of the active portions of the two piezoelectric actuators 12*a*, 12*b* that are aligned with one of the pressure chambers 23, and (b) the respective portions of the internal common electrodes that belong to the one active portion, the one active portion is deformed, by piezoelectric effect, in the direction of stacking of the piezoelectric sheets, and this deformation decreases the volume of the one pressure chamber 23. Consequently a droplet of ink is ejected from the nozzle 11*a* communicating with the one pressure chamber 23, and a desired image is printed or recorded on the recording sheet 62.

In the present embodiment, the head unit 6 includes the single cavity unit 10 and the two piezoelectric actuators 12 (12*a*, 12*b*). However, the ink jet printer head 63 may employ an arbitrary number of head units 6, each of which may be constructed in an arbitrary manner. For example, the head unit 6 may include a single cavity unit 10 and a single piezoelectric actuator 12; and the ink jet printer head 63 may employ a plurality of head units 6 each of which includes a single cavity unit 10 and a single piezoelectric actuator 12 and which are arranged in an array. Moreover, the cavity unit 10 of the head unit 6 may be formed of a ceramic material, in place of the metallic material employed in the illustrated embodiment. Furthermore, the ink jet printer head 63 or the head unit 6 thereof may be driven by a drive device different from the piezoelectric actuators 12 (12*a*, 12*b*). For example, it is possible to employ a diaphragm (i.e., an oscillator plate) which covers the back surface of each pressure chamber 23 and which is oscillated by static elasticity to eject ink from the corresponding nozzle 11*a*.

Next, the manner in which the head unit 6 is fixed to the lower surface of the head holder 1 as the support member will be described. When an ink ejecting operation is performed by deformation of a portion of a piezoelectric actuator of a conventional ink jet printer head, in the direction of stacking of piezoelectric sheets of the actuator, that portion of the actuator applies a pressure to a corresponding pressure chamber of a cavity unit of the printer head, but simultaneously a different portion of the cavity unit may be unexpectedly deformed, as discussed previously, so that the phenomenon of cross-talk may occur. To overcome this problem of the conventional printer head, the ink jet printer head 63 in accordance with the present invention employs the cavity unit 10 which includes the spacer sheets 19, 20, 21 at least one 19 of which has the higher rigidity than those of the other sheet members 11, 15, 16, 17, 18, 20, 21, 22, and in which the outer peripheral portion 19*a* (i.e., the four side portions) of the first spacer sheet 19 having the higher rigidity projects outward by the appropriate dimension H1 from the respective outer peripheral portions of the other sheet members 11, 15 through 18, and 20 through 22, as shown in FIG. 4. A plurality of separate portions (or an entirety) of the back surface of the outer peripheral portion 19*a* are fixed with the adhesive 51 to the head holder 1 that is formed, by injecting molding, of a synthetic resin such as polyethylene or polypropylene. Even if, when each piezoelectric actuator 12*a*, 12*b* is operated and displaced, such a pressure or oscillatory wave may be produced which could otherwise cause the cavity unit 10 as a whole to be flexed like a wave propagated in the X direction in which the arrays of ink ejection nozzles 11*a* are spaced from each other, the first spacer sheet 19 having the higher rigidity can effectively restrict the deformation of the cavity unit 10 as a whole. Thus, the present ink jet printer head 63 can effectively prevent the occurrence of the phenomenon of cross-talk, that is, the phenomenon that the pressure or oscillatory wave produced by the displacement of the actuator 12 acts on, or influence, the pressure chambers 23 and/or the manifold chambers 26 corresponding to one or more arrays of nozzles 11*a* that should not eject the ink, so that those nozzles 11*a* may unexpectedly eject the ink.

As shown in FIGS. 2 and 3, a bottom wall 1*a* of the head holder 1 defines a lower surface of the ink-cartridge holding portion 3, and has a slit 87 through which the two flexible flat cables 40, 40 connected to the head unit 6 are passed; two elliptic holes 54, 54 through which the two pairs of cylindrical ink-supply sleeves 4 projecting from the head unit 6 are passed, respectively; and a plurality of through-holes 55 into which the adhesive 51 is poured to fix the projecting portion 19*a* of the first spacer sheet 19 having the higher rigidity, to the bottom wall 1*a*. The adhesive 51 is, e.g., an UV-light (ultraviolet-light) sensitive adhesive as a sort of a photo-curing adhesive.

The slit 53 is formed in an intermediate portion of the bottom wall 1*a* of the head holder 1, and is elongate in the Y direction. Each of the through-holes 55 formed through the thickness of the bottom wall 1*a* has an inverted-trapezoidal cross section, i.e., an upper open end of the each through-hole 55 has an area larger than that of a lower open end of the same 55. The through-holes 55 are provided in two arrays along two long sides of the bottom wall 1*a*, i.e., in the Y direction, such that the through-holes 55 are opposed to the upper surface of the projecting portion 19*a* of the first spacer sheet 19 of the cavity unit 10.

However, the first spacer sheet 19 having the higher rigidity may be fixed to the bottom wall 1*a* of the head holder 1, with mechanical members, such as clips or vises, in place of the adhesive 51.

In the illustrated embodiment, the rigidity of the spacer sheet 19 is higher than the rigidity of each of the other sheet members 11, 15 through 18, 20 through 22, by not less than 100%. However, more preferably, the former rigidity is higher than the latter rigidity by not less than 200%, not less than 300%, or not less than 500%.

In the illustrated embodiment, one 19 of the spacer sheets 19, 20, 21 has the thickness greater than that of each of the other sheet members 11, 15 through 18, 20 through 22, and accordingly the one spacer sheet 19 has the rigidity higher than the rigidity of each of the other sheet members. According to this feature, the spacer sheet 19 has the higher rigidity by just having the greater thickness. Thus, the high rigidity sheet 19 can be produced at low cost.

In the modified form of the illustrated embodiment, one 19 of the spacer sheets 19, 20, 21 has a modulus of longitudinal elasticity greater than that of each of the other sheet members 11, 15 through 18, 20 through 22. According to this feature, the one spacer sheet 19 has the higher rigidity by just being formed of the material having the greater modulus of longitudinal elasticity. Thus, the dimensions of the cavity unit 10 as a whole need not be significantly largely changed from those of a conventional one, and accordingly the modification of the process of producing the cavity unit 10 can be minimized.

In the illustrated embodiment, the outer peripheral portion 19*a* of the spacer sheet 19 having the higher rigidity projects outward from the respective outer peripheral portions of the other sheet members 11, 15 through 18, 20 through 22. According to this feature, the spacer sheet 19 having the higher rigidity has the plan-view shape larger than those of the other sheet members. Thus, the cavity unit 10 as a whole is not easily deformed even if only the outer peripheral portion 19*a* of the spacer sheet 19 may be grasped by a working person. Thus, the cavity unit 10 can be handled with ease.

In the illustrated embodiment, the cavity unit 10 and the actuator 12 cooperate with each other to provide the head unit 6, and the ink jet printer head 100 additionally includes the head holder 1 as the support member that supports the head unit 6 in such a manner that the outer peripheral portion 19*a* of the spacer sheet 19 of the cavity unit 10 is fixed to the head holder 1. According to this feature, the outer peripheral portion 19*a* of the spacer sheet 19 having the higher rigidity is utilized to fix the head unit 6 to the head holder 1. Therefore, the head unit 6 can be fixed to the head holder 1 with improved reliability.

It is to be understood that the present invention may be embodied with other changes and improvements that may occur to a person skilled in the art, without departing from the spirit and scope of the invention defined in the claims.

What is claimed is:

1. An ink jet printer head, comprising:

a cavity unit having a plurality of ink ejection nozzles arranged in at least one array, and a plurality of pressure chambers arranged in at least one array and communicating with the ink ejection nozzles, respectively; and an actuator having a plurality of active portions each of which is driven to change a pressure of an ink accommodated in a corresponding one of the pressure chambers, and thereby eject, from a corresponding one of the ink ejection nozzles, a droplet of the ink, wherein the cavity unit and the actuator are stacked on each other, wherein the cavity unit is constituted by a plurality of sheet members which are stacked on each other and which include a base sheet having the pressure chambers; at least one manifold sheet which has at least one manifold chamber storing the ink supplied from an ink supply source and delivering the ink to each of the pressure chambers, at a location where said at least one manifold chamber is at least partly opposed to said each pressure chamber in a direction of stacking of the sheet members; at least one spacer sheet which is interposed between the base sheet and said at least one manifold sheet; and a nozzle sheet having the ink ejection nozzles communicating with the pressure chambers, wherein said at least one spacer sheet is more rigid than each of the sheet members other than said at least one spacer sheet, and wherein said at least one spacer sheet has a thickness of from about 300 μm to about 500 μm, and each of at least the base sheet and said at least one manifold sheet has a thickness of from about 50 μm to about 150 μm.

2. The ink jet printer head according to claim 1, wherein the sheet members include a plurality of said spacer sheets which are interposed between the base sheet and said at least one manifold sheet and which include a high rigidity spacer sheet having the thickness of from about 300 μm to about 500 μm, and a low rigidity spacer sheet which is less rigid than the high rigidity spacer sheet.

3. The ink jet printer head according to claim 1, wherein said at least one spacer sheet is more rigid than said each of the sheet members other than said at least one spacer sheet by not less than 100%.

4. The ink jet printer head according to claim 1, wherein said at least one spacer sheet is thicker than said each of the sheet members other than said at least one spacer sheet, so that said at least one spacer sheet is more rigid than said each of the sheet members other than said at least one spacer sheet.

5. The ink jet printer head according to claim 1, wherein said at least one spacer sheet has a modulus of longitudinal elasticity higher than a modulus of longitudinal elasticity of the sheet members other than said at least one spacer sheet, so that said at least one spacer sheet is more rigid than said each of the sheet members other than said at least one spacer sheet.

6. The ink jet printer head according to claim 1, wherein said at least one spacer sheet is formed of a material selected from the group consisting of a nickel chromium molybdenum steel, a stainless steel, a tungsten steel, and a cobalt chromium tungsten steel, and each of at least the base sheet and said at least one manifold sheet is formed of a tough hardening chromium steel.

7. The ink jet printer head according to claim 1, wherein said at least one spacer sheet is formed of a material which is selected from the group consisting of a carbon steel and an alloy steel and whose rigidity is increased by quenching.

8. The ink jet printer head according to claim 1, wherein an outer peripheral portion of said at least one spacer sheet projects outward from respective outer peripheral portions of the other sheet members than said at least one spacer sheet.

9. The ink jet printer head according to claim 8, wherein the cavity unit and the actuator cooperate with each other to provide a head unit, and wherein the ink jet printer head further comprises a support member which supports the head unit such that the outer peripheral portion of said at least one spacer sheet is fixed to the support member.

10. The ink jet printer head according to claim 9, wherein the head unit further comprises a cable member which supplies a plurality of electric signals to the actuator so as to drive the active portions thereof, respectively.

11. The ink jet printer head according to claim 1, wherein the actuator comprises a piezoelectric actuator.

12. The ink jet printer head according to claim 1, wherein the cavity unit has the ink ejection nozzles arranged in a plurality of arrays, and the pressure chambers arranged in a plurality of arrays.

13. The ink jet printer head according to claim 1, wherein the ink jet printer head comprises a full-color ink jet printer head, and the ink ejection nozzles are arranged in four arrays which are spaced from each other and which correspond to four color inks, respectively.

14. The ink jet printer head according to claim 1, wherein the nozzle sheet is formed of a resin.

15. An ink jet printer head, comprising:

a cavity unit having a plurality of ink ejection nozzles arranged in at least one array, and a plurality of pressure chambers arranged in at least one array and communicating with the ink ejection nozzles, respectively; and an actuator having a plurality of active portions each of which is driven to change a pressure of an ink accommodated in a corresponding one of the pressure chambers, and thereby eject, from a corresponding one of the ink ejection nozzles, a droplet of the ink, wherein the cavity unit and the actuator are stacked on each other, wherein the cavity unit is constituted by a plurality of sheet members which are stacked on each other and which include a base sheet having the pressure chambers; at least one manifold sheet which has at least one manifold chamber storing the ink supplied from an ink supply source and delivering the ink to each of the pressure chambers, at a location where said at least one manifold chamber is at least partly opposed to said each pressure chamber in a direction of stacking of the sheet members; at least one spacer sheet which is interposed between the base sheet and said at least one manifold sheet; and a nozzle sheet having the ink ejection nozzles communicating with the pressure chambers, and wherein an outer peripheral portion of said at least one spacer sheet projects outward from respective outer peripheral portions of the sheet members other than said at least one spacer sheet.

16. The ink jet printer head according to claim 15, wherein the cavity unit and the actuator cooperate with each other to provide a head unit, and wherein the ink jet printer head further comprises a support member which supports the head unit such that the outer peripheral portion of said at least one spacer sheet is fixed to the support member.

17. An ink jet printer head, comprising:

a cavity unit having a plurality of ink ejection nozzles arranged in at least one array, and a plurality of pressure chambers arranged in at least one array and communicating with the ink ejection nozzles, respectively; and an actuator having a plurality of active portions each of which is driven to change a pressure of an ink accommodated in a corresponding one of the pressure chambers, and thereby eject, from a corresponding one of the ink ejection nozzles, a droplet of the ink, wherein the cavity unit and the actuator are stacked on each other, wherein the cavity unit is constituted by a plurality of sheet members which are stacked on each other and which include a base sheet having the pressure chambers; at least one manifold sheet which has at least one manifold chamber storing the ink supplied from an ink supply source and delivering the ink to each of the pressure chambers, at a location where said at least one manifold chamber is at least party opposed to said each pressure chamber in a direction of stacking of the sheet members; at least one spacer sheet which is interposed between the base sheet and said at least one manifold sheet; and a nozzle sheet having the ink ejection nozzles communication with the pressure chambers, wherein each of at least said at least one spacer sheet, the base sheet, and said at least one manifold sheet comprises a metallic sheet, and wherein said at least one spacer sheet is more rigid than each of the sheet members other than said at least one spacer sheet.

18. The ink jet printer head according to claim 17, wherein said each of said at least one spacer sheet, the base sheet, and said at least one manifold sheet comprises, as the metallic sheet a nickel alloy steel sheet.

19. The ink jet printer head according to claim 17, wherein which is selected from the group consisting of a carbon steel and an alloy steel and whose rigidity is increased by quenching.

20. The ink jet printer head according to claim 19, wherein each of at least the base sheet and said at least one manifold sheet is formed of a tough hardening chromium steel.

21. The ink jet printer head according to claim 17, wherein said at least one spacer sheet is formed of a material which is selected from the group consisting of a carbon steel and an alloy steel.

22. The ink jet printer head according to claim 21, wherein a rigidity of said at least one spacer sheet is increased by quenching the material selected from the group consisting of the carbon steel and the alloy steel.

* * * * *